US011295656B2

(12) United States Patent
Ji et al.

(10) Patent No.: US 11,295,656 B2
(45) Date of Patent: Apr. 5, 2022

(54) DRIVING METHOD, DRIVING CIRCUIT, AND DISPLAY DEVICE

(71) Applicant: HKC CORPORATION LIMITED, Shenzhen (CN)

(72) Inventors: Feilin Ji, Chongqing (CN); Wei Chen, Chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/296,556

(22) PCT Filed: Dec. 31, 2019

(86) PCT No.: PCT/CN2019/130286
§ 371 (c)(1),
(2) Date: May 25, 2021

(87) PCT Pub. No.: WO2020/156006
PCT Pub. Date: Aug. 6, 2020

(65) Prior Publication Data

US 2022/0028318 A1 Jan. 27, 2022

(30) Foreign Application Priority Data

Jan. 29, 2019 (CN) ..... 201910086725.X

(51) Int. Cl.
*G09G 3/20* (2006.01)

(52) U.S. Cl.
CPC ..... *G09G 3/20* (2013.01); *G09G 2310/0243* (2013.01); *G09G 2310/08* (2013.01); *G09G 2320/0247* (2013.01)

(58) Field of Classification Search
CPC ..... G09G 3/20; G09G 2310/0243; G09G 2310/08; G09G 2320/0247
See application file for complete search history.

(56) References Cited

U.S. PATENT DOCUMENTS

2017/0124965 A1 5/2017 Verbeure
2020/0355971 A1* 11/2020 Gao ..... G02F 1/136286
2020/0356203 A1* 11/2020 Wang ..... G06F 3/0412

FOREIGN PATENT DOCUMENTS

CN 1288329 A 3/2001
CN 101496089 A 7/2009
(Continued)

OTHER PUBLICATIONS

Huixia Gao, the International Searching Authority written comments, Mar. 2020, CN.
Huixia Gao, the International Searching Report, Mar. 2020, CN.

*Primary Examiner* — Sejoon Ahn

(57) ABSTRACT

The present disclosure provides a driving method, a driving circuit, and a display device. The driving method includes steps of receiving a data signal of a first standard, generating a first data frame, and driving a display panel at a refresh frequency of the first data frame and receiving the data signal of the second standard, calculating and generating at least one transition frame according to the data signal of the first standard and the data signal of the second standard, and driving the display panel at a refresh frequency corresponding to the at least one transition frame. A refresh frequency of the at least one transition frame is between a refresh frequency of the first data frame and a refresh frequency of the second data frame.

20 Claims, 4 Drawing Sheets

(56) References Cited

FOREIGN PATENT DOCUMENTS

| | | | |
|---|---|---|---|
| CN | 109215594 | A | 1/2019 |
| CN | 109616083 | A | 4/2019 |

* cited by examiner

DRIVING METHOD, DRIVING CIRCUIT, AND DISPLAY DEVICE

CROSS REFERENCE OF RELATED APPLICATIONS

The present application claims foreign priority to Chinese Patent Application No. CN201910086725.X, titled "DRIVING METHOD, DRIVING CIRCUIT, AND DISPLAY DEVICE," filed on Jan. 29, 2019 in the National Intellectual Property Administration, and the entire contents of which is hereby incorporated by reference.

TECHNICAL FIELD

The present disclosure relates to a field of display technology, and in particular to a driving method, a driving circuit, and a display device.

BACKGROUND

The statements here only provide background information related to the present disclosure, and do not necessarily constitute prior art.

There are three main types of television standards worldwide, which include Phase Alteration Line (PAL) standard, National Television Standards Committee (NTSC) standard, and Sequentiel Couleur A Memoire (SECAM) standard. Commonly used standards are the PAL standard and the NTSC standard. A data signal of the PAL standard, such as format of a TV signal, is 25 frames per second. After a system on a chip (SOC) decodes and multiplies the frequency, it is output as a data frame of 50 frames per second to a display panel, which has a refresh frequency of 50 Hz. (Hz). In the NTSC standard, the TV signal includes 30 frames per second, which is processed by SOC and output as a data frame of 60 frames per second to the display panel. In the situation, the image is restored at a refresh frequency of 60 Hz.

When the PAL standard is switched to the NTSC standard, or the NTSC standard is switched to the PAL standard, since the refresh frequency output by the SOC is different, the refresh frequency received by the display panel has a large change, and screen flickering is likely to occur at this time.

SUMMARY

An object of the present disclosure is to provide a driving method, a driving circuit, and a display device.

The present disclosure provides a driving method. The driving method includes steps:

receiving a data signal of a first standard, generating a first data frame, and driving a display panel at a refresh frequency of the first data frame;

receiving a data signal of a second standard, calculating and generating at least one transition frame according to the data signal of the first standard and the data signal of the second standard, and driving the display panel at a refresh frequency corresponding to the at least one transition frame; and continuing to receive the data signal of the second standard, generating a second data frame, and driving the display panel at a refresh frequency of the second data frame.

The refresh frequency of the first data frame differs from the refresh frequency of the second data frame. The refresh frequency of the at least one transition frame is between the refresh frequency of the first data frame and the refresh frequency of the second data frame.

The present disclosure further provide a driving circuit. The driving circuit includes a receiving circuit receiving a data signal;

a data frame generating circuit receiving and switching the data signal to generate a corresponding data frame:

a transition frame generating circuit generating transition frames according to the received data signal; and a standard switching detecting circuit detecting the data signal received by the receiving circuit, controlling the data frame generating circuit to generate the data frame, and controlling the transition frame generating circuit to generate the transition frames.

When the standard switching detecting circuit detects that the received data signal is a data signal of a first standard, it controls a first data frame generated by the data frame generating circuit corresponding to the data signal of the first standard to drive a display panel.

When the standard switching detecting circuit detects that the received data signal is switched from the data signal of the first standard to a data signal of a second standard, it controls the transition frame generating circuit to generate the transition frames to drive the display panel. Then a second data frame generated by the data frame generating circuit corresponding to the data signal of the second standard is applied to drive the display panel.

A refresh frequency of the first data frame differs from a refresh frequency of the second data frame. A refresh frequency of the transition frames is between the refresh frequency of the first data frame and the refresh frequency of the second data frame.

The present disclosure further provides a display device that includes a display and the driving circuit mentioned above.

Compared with a solution of directly switching between data signals of different standards, the present disclosure calculates and generates the at least one transition frame according to the received data signals of two different standards when switching between different standards. The generated refresh frequency of the at least one transition frame is between refresh frequencies of data frames of two different standards. The refresh frequency of the first data frame corresponding to the data signal of the first standard is switched to the refresh frequency of the at least one transition frame first, and then the refresh frequency of the at least one transition frame is switched to the refresh frequency of the second data frame corresponding to the data signal of the second standard, so that the difference in refresh frequencies between two adjacent frames is reduced, a screen of the display panel would not flicker due to excessive difference in refresh frequencies of the two adjacent frames, and display of the display panel is excellent.

BRIEF DESCRIPTION OF DRAWINGS

The drawings are included to provide a further understanding of embodiments of the present disclosure, which form portions of the specification and are used to illustrate implementation manners of the present disclosure and are intended to illustrate operating principles of the present disclosure together with the description. Apparently, the drawings in the following description are merely some of the embodiments of the present disclosure, and those skilled in the art are able to obtain other drawings according to the drawings without contributing any inventive labor. In the drawing.

DETAILED DESCRIPTION

It should be understood that specific structure and function details disclosed herein are only representative and are used for the purpose of describing exemplary embodiments of the present disclosure. However, the present disclosure may be achieved in many alternative forms and shall not be interpreted to be only limited to the embodiments described herein.

It should be understood in the description of the present disclosure that terms such as "first" and "second" are only used for the purpose of description, rather than being understood to indicate or imply relative importance or hint the number of indicated technical features. Thus, the feature limited by "first" and "second" can explicitly or impliedly include one or more features. In the description of the present disclosure, the meaning of "a plurality of" is two or more unless otherwise specified. The term "include" and any variant are intended to cover non-exclusive inclusion, which may exist or add one or more other features, integers, steps, operations, units, components, and/or combinations thereof.

In addition, terms such as "central", "horizontal", "upper", "lower", "left", "right", "vertical", "horizontal", "top", "bottom", "inner". "outer", etc. indicate direction or position relationships shown based on the drawings, and are only intended to facilitate the description of the present disclosure and the simplification of the description rather than to indicate or imply that the indicated device or element must have a specific direction or constructed and operated in a specific direction, and therefore, shall not be understood as a limitation to the present disclosure.

In addition, It should be noted in the description of the present disclosure that, unless otherwise regulated and defined, terms such as "installation," "bonded," and "bonding" shall be understood in broad sense, and for example, may refer to fixed bonding or detachable bonding or integral bonding; may refer to mechanical bonding or electrical bonding; and may refer to direct bonding or indirect bonding through an intermediate medium or inner communication of two elements. For those of ordinary skill in the art, the meanings of the above terms in the present disclosure may be understood according to concrete conditions.

The present disclosure will be further described in detail below in combination with the drawings and optional embodiments.

Figure 1:
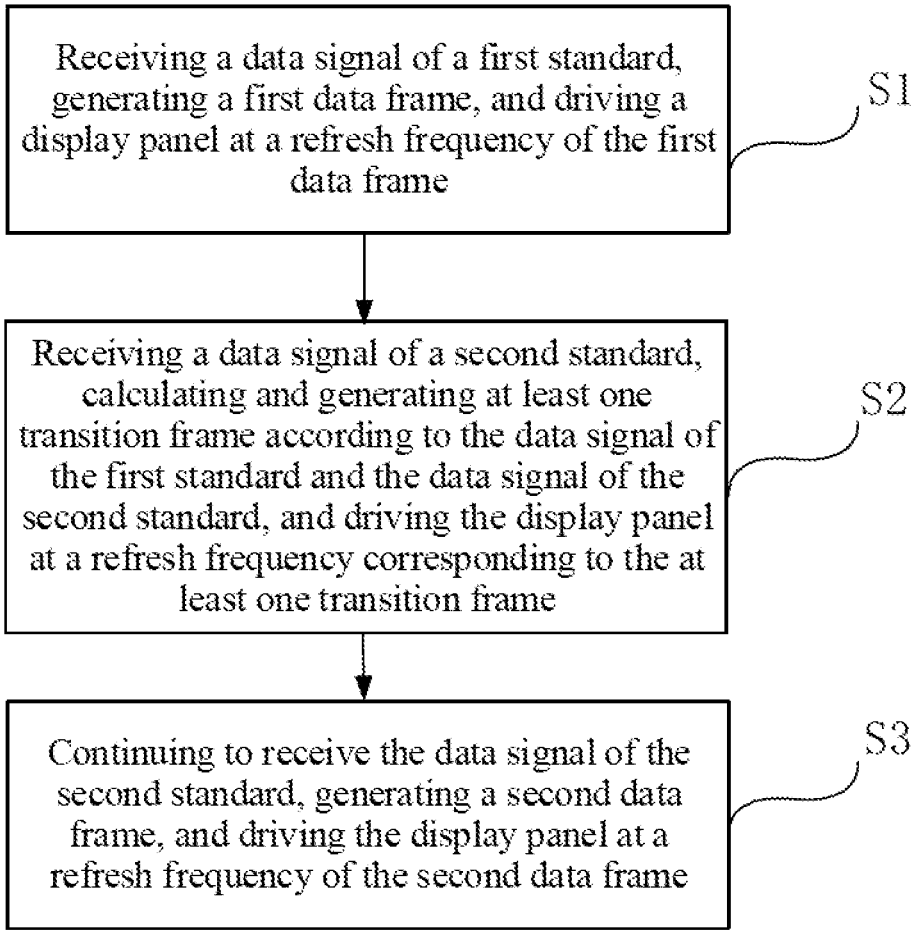
FIG. 1 is a flow chart of a driving method according to one embodiment of the present disclosure.

As shown in FIG. 1, the present disclosure provides a driving method. The driving method includes steps:

S1: receiving a data signal of a first standard, generating a first data frame, and driving a display panel at a refresh frequency of the first data frame;

S2: receiving a data signal of a second standard, calculating and generating at least one transition frame according to the data signal of the first standard and the data signal of the second standard, and driving the display panel at a refresh frequency corresponding to the at least one transition frame; and S3: continuing to receive the data signal of the second standard, generating a second data frame, and driving the display panel at a refresh frequency of the second data frame.

The refresh frequency of the first data frame differs from the refresh frequency of the second data frame. The refresh frequency of the at least one transition frame is between the refresh frequency of the first data frame and the refresh frequency of the second data frame.

Figure 2:
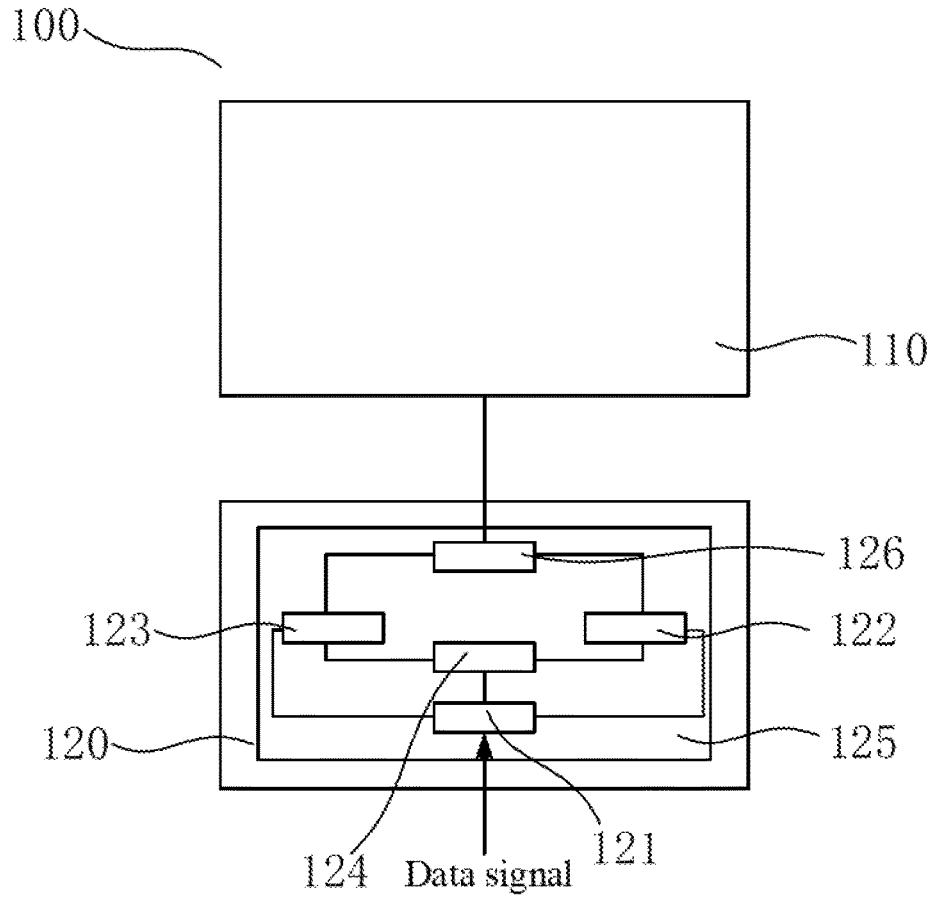
FIG. 2 is a schematic diagram showing a structure of a display panel and a driving circuit according to one embodiment of the present disclosure.

FIG. 2 shows structures of the corresponding display device 100 and driving circuit. The display device includes a display panel 110 and a driving circuit 120. The driving circuit 120 drives the display panel 110 to display. The driving circuit 120 includes a receiving circuit 121 receiving a data signal, a data frame generating circuit 122 receiving and switching the data signal to generate a corresponding data frame; a transition frame generating circuit 123 generating transition frames according to the received data signal, and a standard switching detecting circuit 124.

The transition frame generating circuit 123 is directly connected to the receiving circuit 121. The data frame generating circuit 122 is directly connected to the receiving circuit 121. The standard switching detecting circuit 124 detects the data signal received by the receiving circuit, and selectively controls the data frame generating circuit 122 to generate the data frame or controls the transition frame generating circuit 123 to generate the transition frames to drive the display panel.

When the standard switching detecting circuit detects that the received data signal is a data signal of a first standard, it controls a first data frame generated by the data frame generating circuit corresponding to the data signal of the first standard to drive the display panel. When the standard switching detecting circuit detects that the received data signal is switched from the data signal of the first standard to a data signal of a second standard, it controls the transition frame generating circuit to generate the transition frame to drive the display panel. Then a second data frame generated by the data frame generating circuit corresponding to the data signal of the second standard is applied to drive the display panel.

The driving circuit 120 further includes a system chip 125 and a timing control circuit 126. The receiving circuit 121, the data frame generating circuit 122, the transition frame generating circuit 123, and the standard switching detecting circuit 124 are integrated on the system chip 125. The data frame generated by the data frame generating circuit 122 and the transition frames generated by the transition frame generating circuit 123 are sent to the timing control circuit 126 to drive the display panel.

When the data signal is switched from the first standard to the second standard, the PAL standard and the NTSC standard are taken as examples of the standards of the TV signal. The refresh frequencies of the data frames driving the display panel generated by the data frame generating circuit of the display panel are different. If the refresh frequencies of the data frames generated by the two standards differs greatly, a difference between two adjacent frames is too large when the two standards are switched from one to the other, which causes the screen to flicker, brings a bad sensory experience to a user, affects a display effect.

In order to avoid the difference between the two refresh frequency values when the two standards are switched from one to the other, when the data signals of the two standards are switched, at least one transition frame is calculated and generated according to the received data signals of the two standards, so that the refresh frequency of the at least one transition frame is between the refresh frequency of the first data frame and the refresh frequency of the second data frame The refresh frequency of the first data frame corresponding to the data signal of the first standard is switched to the refresh frequency of the transition frame first, and then the refresh frequency of the transition frame is switched to the refresh frequency of the second data frame corresponding to the data signal of the second standard, so that the difference in refresh frequency between two adjacent frames is reduced, and the screen would not flicker due to the excessive difference in refresh frequencies, and the display effect of the display panel is good.

In addition, in some embodiments, the driving circuit of the display panel includes a frequency locking circuit for protection. When fluctuation of a signal frequency of the data signal exceeds a predetermined threshold, the frequency locking circuit triggers a frequency lock function, determines that an input data signal is abnormal, and interrupts the input data signal to protect the display panel. Therefore, for a frequency-locked display panel, when the standards of the input data signals are switched, the generated transition frames are inserted, and the frequency difference between two adjacent frames is reduced. Thus, even if the frequency difference between the two standards is large, it would not cause false triggering of the frequency locking circuit and avoid affecting normal display of the display panel.

Of course, the first standard is the PAL standard, the NTSC standard or other standards, and the second standard is PAL standard, the NTSC standard or other standards. The data frame generating circuit decodes and multiplies the data signal received by the receiving circuit to generate a data frame. The data frame uses different formats for inputting to display panels of different resolutions, For the display panel with High Definition (HD) resolution or Full High Definition (FHD) resolution, the data frame is input by Low-Voltage Differential Signaling (LVDS) signal format. For the display panel with Ultra High-Definition (UHD) resolution or even higher resolutions, the data frame is input to the display panel by a video by one (VBO) signal format.

Specifically, in the step S2, the number of frames of the generated at least one transition frame is optionally set from 2 to 5 frames, and the refresh frequency of each transition frame is calculated according to the number of frames set in the transition frames. A difference between refresh frequencies of any two adjacent frames in a last frame of the first data frame, the transition frames, and a first frame of the second data frame is equal.

It should be noted that the difference between the refresh frequencies of adjacent transition frames is a fixed value. In the last frame of the first data frame, the transition frames, and the first frame of the second data frame, the frequency of any two adjacent frames increases or decreases in sequence with the fixed value. If the refresh frequency of the first standard is greater than the refresh frequency of the second standard, when the first standard is switched to the second standard, the refresh frequencies of the transition frames are sequentially increased. When the second standard is switched to the first standard, the refresh frequencies of the transition frames are sequentially decreased. Or, the difference between the refresh frequencies of adjacent transition frames is a variable value, and the variable value may increase or decrease sequentially.

Figure 3:
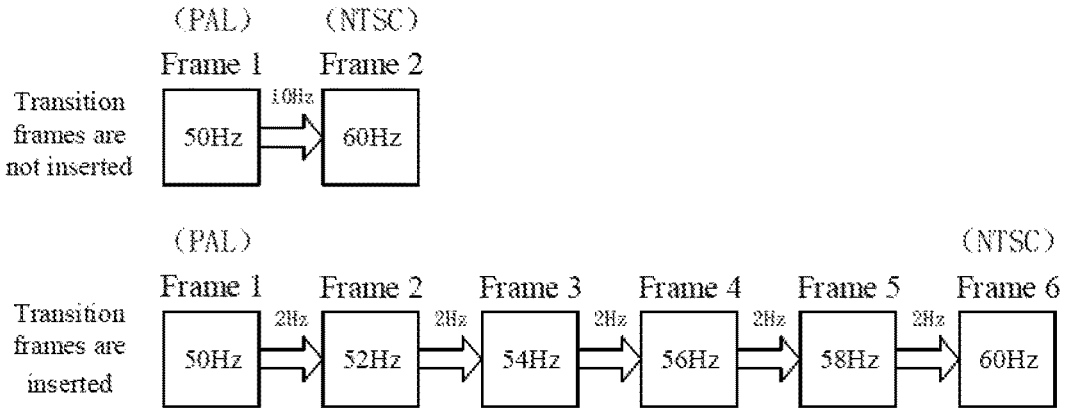
FIG. 3 is a schematic diagram of a specific implementation of switching of a data signal standard according to one embodiment of the present disclosure.

The number of transition frames may be 2, 3, 4, or 5 frames. Selection of the number of transition frames mainly refers to the difference between the refresh frequency of the first data frame corresponding to the data signal of the first standard and the refresh frequency of the second data frame corresponding to the data signal of the second standard. As shown in FIG. 3, the present disclosure still takes the PAL standard and NTSC standard as the first standard and the second standard as an example, the difference of the refresh frequencies between the PAL standard and the NTSC standard is 10 Hz, and the number of the transition frames may be selected from 2 to 5 frames, which is set to be 4 frames in the embodiment. The difference of the refresh frequencies between two adjacent transition frames is selected according to the number of the transition frames. If the number of the transition frames is less than 2 frames, then the difference between the refresh frequency of the transition frame and the refresh frequency of the first data frame corresponding to the data signal of the first standard and the difference between the refresh frequency of the transition frame and the refresh frequency of the second data frame corresponding to the data signal of the second standard may still be quite large and the display panel may still flicker slightly. If the transition frames exceeds 5 frames, although the difference of refresh frequencies between two adjacent frames is small, the longer switching time of the transition frames also affects the display effect.

Of course, the difference of the refresh frequencies between two adjacent transition frames may be predetermined. A specific number of the transition frames is calculated according to the difference between the refresh frequency of the first data frame corresponding to the data signal of the first standard and the refresh frequency of the second data frame corresponding to the data signal of the second standard. For example, the difference between refresh frequencies of any two adjacent frames in the last frame of the first data frame, the transition frames, and the first frame of the second data frame is a fixed value. The fixed value is set in a range of 1-4 Hz to generate refresh frequencies of the frames. For different differences, the number of transition frames is also different. Of course, if the display panel can adapt to the switching of the refresh frequencies of frames with a large difference, then the fixed value is able to be greater than 4 Hz.

In one embodiment, the present disclosure take the switch between the PAL standard and NTSC standard as an example, if the refresh frequency of the PAL standard driving the display panel is 60 Hz, and the refresh frequency of the NTSC standard driving the display panel is 50 Hz, then a recommended fixed value is 2 Hz. The refresh frequency of each transition frame is increased or decreased by 2 Hz, and the difference of the refresh frequencies of two adjacent transition frames is generally set as 2 Hz. When the NTSC standard is switched to the PAL standard, the switching is completed in 5 frames, and the refresh frequency of each frame is 50 Hz, 52 Hz, 54 Hz, 56 Hz, 58 Hz, 60 Hz in sequence. When the PAL standard is switched to the NTSC standard, the switching is completed in 5 frames, and the refresh frequency of each frame is 60 Hz, 58 Hz, 56 Hz, 54 Hz, 52 Hz, 50 Hz in sequence. Therefore, the difference of the refresh frequencies of the frames is small when switching, and the signal is output smoothly without affecting the display effect.

Specifically, the first data frame includes parameter information of a total number of first horizontal lines (Htotal1), parameter information of a total number of first vertical lines (Vtotal1), and parameter information of a first signal transmission frequency (DCLK1). The second data frame includes parameter information of a total number of second horizontal lines (Htotal2), parameter information of a total number of second vertical lines (Vtotal2), and parameter information of a second signal transmission frequency (DCLK2). The transition frames include parameter information of a total number of third horizontal lines (Htotal3), parameter information of a total number of third vertical lines (Vtotal3), and parameter information of a third signal transmission frequency (DCLK3). The total number of the first horizontal lines, the total number of the second horizontal lines, and the total number of the third horizontal lines are equal. The total number of the first vertical lines, the total number of the second vertical lines, and the total number of the third vertical lines are equal. The first signal transmission frequency, the second signal transmission frequency, and the third signal transmission frequency are not equal. The third signal transmission frequency is between the first signal transmission frequency and the second signal transmission frequency. For example, if the refresh frequencies of the frames are in a range of 50-60 Hz, the third signal transmission frequency is less than the first signal transmission frequency and greater than the second signal transmission frequency, then the refresh frequencies of the transition frames are calculate through the third signal transmission frequency. In this way, a best data signal for each transition frame is obtained to drive the display panel by changing only one parameter information of the signal transmission frequency. In the embodiment, only one parameter information is changed, which is easier to perform calculation control than changing multiple parameter information at the same time, reducing a waste of calculation resources.

Of course, in other embodiments, the first signal transmission frequency, the second signal transmission frequency, and the third signal transmission frequency are not equal. Meanwhile, the total number of the first horizontal lines, the total number of the second horizontal lines, and the total number of the third horizontal lines may be different. Even the total number of the first vertical lines, the total number of the second vertical lines, and the total number of the third vertical lines may be different. Changing multiple parameter information at the same time also realizes an effect of controlling the refresh frequencies of the transition frames to be between the refresh frequency of the first data frame and the refresh frequency of the second data frame.

Figure 4:
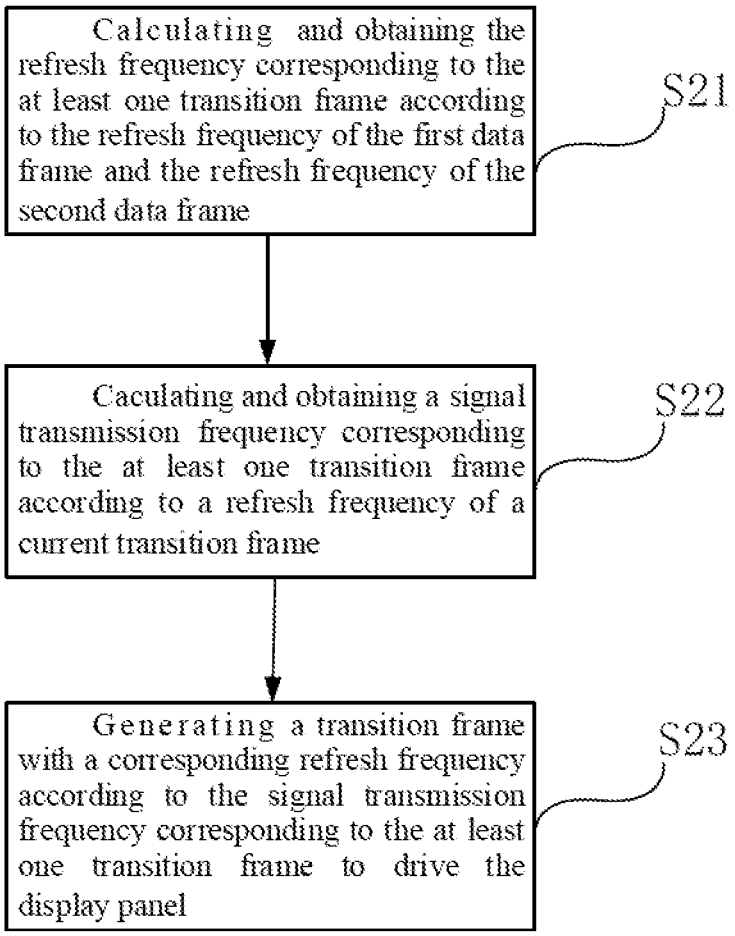
FIG. 4 is a flow chart of generating transition frames according to one embodiment of the present disclosure.

Specifically, as shown in FIG. 4, the step S2 includes following steps:

S21: calculating and obtaining the refresh frequency corresponding to the at least one transition frame according to the refresh frequency of the first data frame and the refresh frequency of the second data frame;

S22: calculating and obtaining a signal transmission frequency corresponding to the at least one transition frame according to a refresh frequency of a current transition frame; and S23: generating a transition frame with a corresponding refresh frequency according to the signal transmission frequency corresponding to the at least one transition frame to drive the display panel.

In the step S22, the signal transmission frequency corresponding to the at least one transition frame is calculated and obtain by following formula:

$$F=\mathrm{DCLK}/(H\mathrm{total}*V\mathrm{total}).$$

F is the refresh frequency of the current transition frame. DCLK is a signal transmission frequency of the current transition frame. Htotal is a total number of horizontal lines of the current transition frame. Vtotal is a total number of vertical lines of the current transition frame. A total number of horizontal lines of a last frame of the first data frame, a total number of horizontal lines of each transition frame, and a total number of horizontal lines of a first frame of the second data frame are equal. A total number of vertical lines of the last frame of the first data frame, a total number of vertical lines of each transition frame, and a total number of vertical lines of the first frame of the second data frame are equal.

Following specific calculations are performed based on the display panel with HD resolution or FHD resolution when the PAL standard is switched to the NTSC standard. Under the PAL standard:

At the HD resolution (1366*768): Vactive=768, Vblank=38, then Vtotal=806; Hactive=1366, Hblank=194, then Htotal=Vactive+Vtotal=1560.

At the FHD resolution (1920*1080): Vactive=1080, Vblank=45, then Vtotal=Vactive+Vtotal=1125; Hactive=960, Hblank=140, then Htotal=1100.

When at UHD resolution (3840*2160), that is, 4K resolution: which is equivalent to 4 times the data volume of FHD resolution.

When at 8K resolution (7680*4320): the data volume is equivalent to 4 times the data volume of UHD resolution. In the present disclosure, only transmission methods of the HD and FHD resolutions are listed herein.

Specifically, the frequency of DLCK is changed 5 times, and the frequency of each frame is 50 Hz→52 Hz→54 Hz→56 Hz→58 Hz→60 Hz in sequence, so that the refresh frequency is switched from 50 Hz to 60 Hz. During a switching process, for a display panel with the HD resolution, the total number of the horizontal lines of the last frame of the first data frame, the total number of the horizontal lines of the transition frames, and the total number of the horizontal lines of the first frame of the second data frame are always 806, and the total number of the vertical lines of the last frame of the first data frame, the total number of the vertical lines of the transition frames, and the total number of the vertical lines of the first frame of the second data frame are always 1560. During the switching process, for the display panel with the FHD resolution, the total number of the horizontal lines of the last frame of the first data frame, the total number of the horizontal lines of the transition frames, and the total number of the horizontal lines of the first frame of the second data frame are always 1125, and the total number of the vertical lines of the last frame of the first data frame, the total number of the vertical lines of the transition frames, and the total number of the vertical lines of the first frame of the second data frame are always 1100. Calculating processes of values of the signal transmission frequency value of the transition frames in step S22 is as follows:

Frame 1 (the last frame of the PAL standard):

At HD resolution: $DCLK=50*1560*806=62.868$ MHz;

At FHD resolution: $DCLK=50*1100*1125=61.875$ MHz.

Frame 2 (the first frame of the transition frame):

At HD resolution: $DCLK=52*1560*806=65.38272$ MHz;

At FHD resolution: *DCLK*=52*1100*1125=64.35 MHz;

Frame 3 (the second frame of the transition frame):

At HD resolution: *DCLK*=54*1560*806=67.89744 MHz;

At FHD resolution: *DCLK*=54*1100*1125=66.825 MHz;

Frame 4 (the third frame of the transition frame):

At HD resolution: *DCLK*=56*1560*806=70.41216 MHz;

At FHD resolution: *DCLK*=56*1100*1125=69.3 MHz;

Frame 5 (the fourth frame of the transition frame):

At HD resolution: *DCLK*=58*1560*806=72.92688 MHz;

At FHD resolution: *DCLK*=58*1100*1125=71.775 MHz;

Frame 6 (the last frame of the NSTC system):

At HD resolution: *DCLK*=60*1560*806=75.4416 MHz;

At FHD resolution: *DCLK*=60*1100*1125=74.25 MHz.

Figure 5:
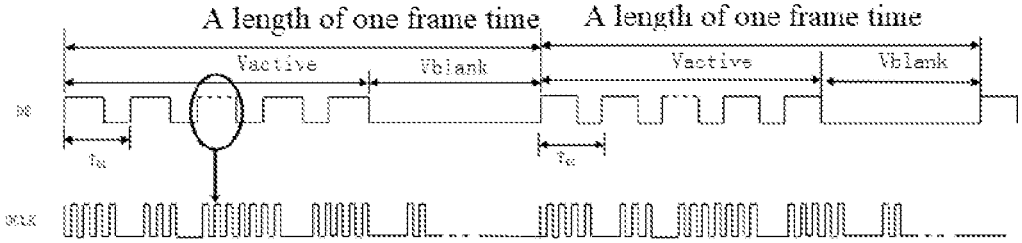
FIG. 5 is a schematic diagram of an enable signal according to one embodiment of the present disclosure.

In step S22, corresponding transition frames including an enable signal (DE) and an image data signal (Data) is also generated. As shown FIG. 5, where TH1 is time of one horizontal line, when DE is at a high level 1, a corresponding image data signal is valid, and when DE is at a low level 0, a corresponding image data signal is invalid. A signal transmission frequency of the enable signal (DE) is same as a signal transmission frequency of the image data signal (data). In a signal transmission frequency (DCLK) period, data of 1 pixel (pixel) of a frame of image is transmitted. When the refresh frequencies of the transition frames are changed, a period of DE and Data is prolonged, the time corresponding to each frame is prolonged, and a period of the image data signal transmitted to the display panel is prolonged.

Above embodiments shows driving steps for switching from the PAL standard to the NTSC standard. If the NTSC standard is switched to the PAL standard, the above steps are reversed.

Figure 6:
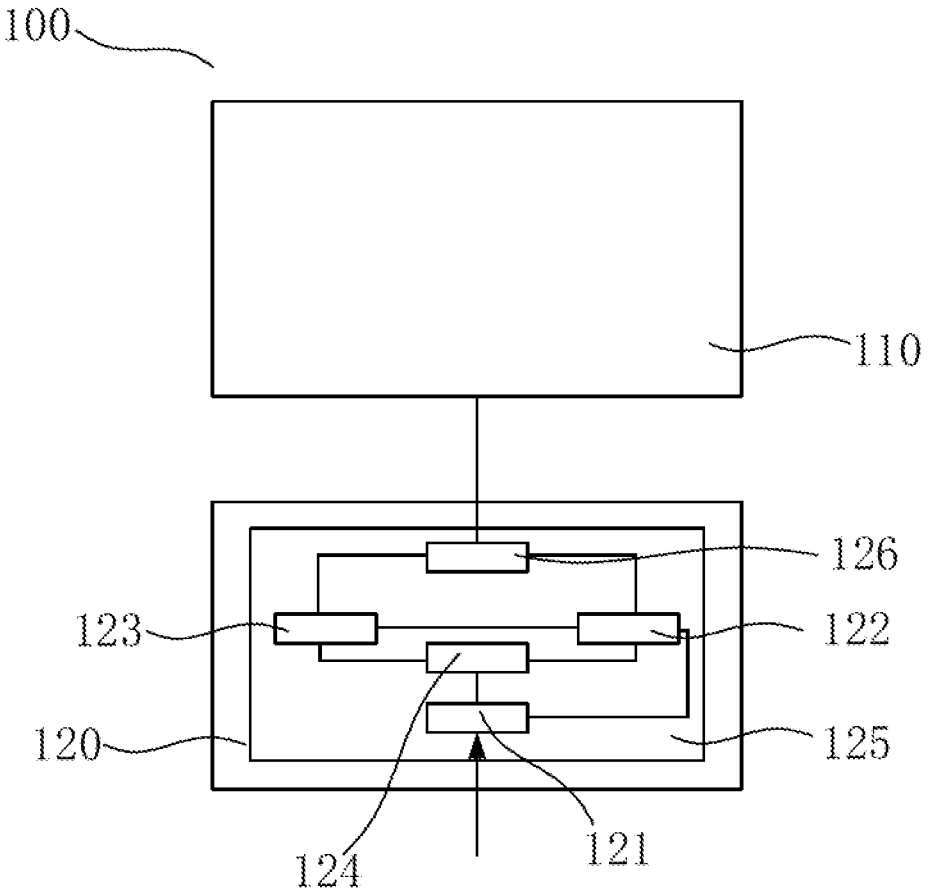
FIG. 6 is a schematic structural diagram of a display device and a driving circuit according to another embodiment of the present disclosure.

The transition frame generating circuit 123 is directly connected to the receiving circuit 121 to obtain the data signal. Of course, as another embodiment of the present disclosure, the present disclosure further provides a driving circuit applying the above driving method. As shown in FIG. 6, the transition frame generating circuit 123 may also be connected with the receiving circuit 121 through the data frame generating circuit 122 to receive a signal of the data frame generated by the data frame generating circuit 122 to generate the transition frames. The standard switching detecting circuit 124 detects the data signal received by the receiving circuit 121 and directly controls the data frame generating circuit 122 to generate the data frame to drive the display panel. Or, the standard switching detecting circuit 124 controls the data frame signal generated by the data frame generating circuit 122 to output to the transition frame generating circuit 123 to generate the transition frames to drive the display panel.

When the standard switching detecting circuit 124 detects that the received data signal is the data signal of the first standard, it controls the data frame signal generated by the data frame generating circuit 122 corresponding to first date frame to drive the display panel. When the standard switching detecting circuit 124 detects that the received data signal is switched from the data signal of the first standard to the data signal of the second standard, it controls and starts the transition frame generating circuit 123. The transition frame generating circuit 123 receives the data signal of the data frame generated by the data frame generation circuit 122, generates the transition frames to drive the display panel. Then the standard switching detecting circuit 124 controls the second data frame generated by the data frame generating circuit corresponding to the data signal of the second standard is applied to drive the display panel.

It should be noted that technical solutions of the present disclosure are able to be combined and applied on a premise of not conflicting with each other. The limitations of the steps involved in the embodiments are not considered as limiting the order of the steps without affecting the implementation of the specific embodiments. The steps written before is able to be executed first, executed later, or even executed simultaneously. As long as the embodiments can be implemented, it should be regarded as falling within the protection scope of the present disclosure.

The technical solutions of the present disclosure are able to be widely used in various display panels, such as Twisted Nematic (TN) display panels, In-Plane Switching (IPS) display panels. Vertical Alignment (VA) display panels, display panels, and Multi-Domain Vertical Alignment (MVA) display panels. Of course, the present disclosure are able to be widely used in other types of display panels, such as Organic Light-Emitting Diode (OLED) display panels, which is also able to be applies to the above embodiments.

The above content is a further detailed description of the present disclosure in conjunction with specific optional embodiments, and is not considered that the specific embodiments of the present disclosure are limited to these descriptions. For those of ordinary skill in the field to which the present disclosure belongs, a number of simple deductions or substitutions can be made without departing from the concept of the present disclosure, which should all be regarded as falling within the protection scope of the present disclosure.

What is claimed is:

1. A driving method, comprising steps:

receiving a data signal of a first standard, generating a first data, frame, and driving a display panel at a refresh frequency of the first data frame;

receiving a data signal of a second standard, calculating and generating at least one transition frame according to the data signal of the first standard and the data signal of the second standard, and driving the display panel at a refresh frequency corresponding to the at least one transition frame; and continuing to receive the data signal of the second standard, generating a second data frame, and driving the display panel at a refresh frequency of the second data frame;

wherein the refresh frequency of the first data frame differs from the refresh frequency of the second data frame; the refresh frequency of the at least one transition frame is between the refresh frequency of the first data frame and the refresh frequency of the second data frame.

2. The driving method according to claim 1, wherein in the step of receiving the data signal of the second standard, calculating and generating the at least one transition frame according to the data signal of the first standard and the data signal of the second standard, and driving the display panel at the refresh frequency corresponding to the at least one transition frame, the number of generated transition frames is no less than 2 frames:

wherein a difference between refresh frequencies of any two adjacent frames in a last frame of the first data frame, the transition frames, and a first frame of the second data. frame is equal and ranges from 1-4 Hz.

3. The driving method according to claim 2, wherein in the generated transition frames, a difference between refresh frequencies of any two adjacent transition frames is 2 Hz.

4. The driving method according to claim 1, wherein in the step of receiving the data signal of the second standard, calculating and generating the at least one transition frame according to the data signal of the first standard and the data signal of the second standard, and driving the display panel at the refresh frequency corresponding to the at least one transition frame, the number of generated transition frames ranges from 2-5 frames;

wherein a difference between refresh frequencies of any two adjacent frames in a last frame of the first data frame, the transition frames, and a first frame of the second data frame is equal.

5. The driving method according to claim 1, wherein the first data frame comprises parameter information of a first signal transmission frequency; the second data frame comprises parameter information of a second signal transmission frequency; the at least one transition frame comprises parameter information of a third signal transmission frequency;

wherein the first signal transmission frequency, the second signal transmission frequency, and the third signal transmission frequency are different with each other; the third signal transmission frequency is between the first signal transmission frequency and the second signal transmission frequency.

6. The driving method according to claim 1, wherein the first data frame comprises parameter information of a total number of first horizontal lines, parameter information of a total number of first vertical lines, and parameter information of a first signal transmission frequency; the second data frame comprises parameter information of a total number of second horizontal lines, parameter information of a total number of second vertical lines, and parameter information of a second signal transmission frequency; the at least one transition frame comprises parameter information of a total number of third horizontal lines, parameter information of a total number of third vertical lines, and parameter information of a third signal transmission frequency;

wherein the total number of the first horizontal lines, the total number of the second horizontal lines, and the total number of the third horizontal lines are equal; the total number of the first vertical lines, the total number of the second vertical lines, and the total number of the third vertical lines are equal; the first signal transmission frequency, the second signal transmission frequency, and the third signal transmission frequency are not equal; the third signal transmission frequency is between the first signal transmission frequency and the second signal transmission frequency.

7. The driving method according to claim 6, wherein the step of receiving the data signal of the second standard, calculating and generating the at least one transition frame according to the data signal of the first standard and the data signal of the second standard, and driving the display panel at the refresh frequency corresponding to the at least one transition frame comprises steps:

calculating and obtaining the refresh frequency corresponding to the at least one transition frame according to the refresh frequency of the first data frame and the refresh frequency of the second data frame;

calculating and obtaining a signal transmission frequency corresponding to the at least one transition frame according to a refresh frequency of a current transition frame; and generating a transition frame with a corresponding refresh frequency according to the signal transmission frequency corresponding to the at least one transition frame to drive the display panel.

8. The driving method according to claim 1, wherein the first data frame comprises parameter information of a total number of first horizontal lines, parameter information of a total number of first vertical lines, and parameter information of a first signal transmission frequency; the second data frame comprises parameter information of a total number of second horizontal lines, parameter information of a total number of second vertical lines, and parameter information of a second signal transmission frequency; the at least one transition frame comprises parameter information of a total number of third horizontal lines, parameter information of a total number of third vertical lines, and parameter information of a third signal transmission frequency;

wherein the first signal transmission frequency, the second signal transmission frequency, and the third signal transmission frequency are not equal, the third signal transmission frequency is between the first signal transmission frequency and the second signal transmission frequency.

9. The driving method according to claim 7, wherein in the step of calculating and obtaining the signal transmission frequency corresponding to the at least one transition frame according to the refresh frequency of the current transition frame, the signal transmission frequency corresponding to the at least one transition frame is calculated by following formula:

$$F=\mathrm{DCLK}/(H\mathrm{total}*V\mathrm{total});$$

wherein F is the refresh frequency of the current transition frame; DCLK is a signal transmission frequency of the current transition frame; Htotal is a total number of horizontal lines of the current transition frame; Vtotal is a total number of vertical lines of the current transition frame: a total number of horizontal lines of a last frame of the first data frame, a total number of horizontal lines of each transition frame, and a total number of horizontal lines of a first frame of the second data frame are equal; a total number of vertical lines of the last frame of the first data frame, a total number of vertical lines of each transition frame, and a total number of vertical lines of the first frame of the second data frame are equal.

10. The driving method according to claim 7, wherein the step of generating the transition frame with the corresponding refresh frequency according to the signal transmission frequency corresponding to the at least one transition frame to drive the display panel comprises:

generating an enable signal and an image data signal in a data signal of a corresponding transition frame to drive the display panel according to the signal transmission frequency corresponding to the at least one transition frame.

11. The driving method according to claim 10, wherein when the enable signal is at a high level, a corresponding image data signal is valid.

12. A driving circuit, comprising:

a receiving circuit receiving a data signal;

a data frame generating circuit receiving and switching the data signal to generate a corresponding data frame;

a transition frame generating circuit generating transition frames according to the received data signal; and a standard switching detecting circuit detecting the data signal received by the receiving circuit, controlling the data frame generating circuit to generate the data frame, and controlling the transition frame generating circuit to generate the transition frames;

wherein when the standard switching detecting circuit detects that the received data signal is a data signal of a first standard, it controls a first data frame generated by the data frame generating circuit corresponding to the data signal of the first standard to drive a display panel;

when the standard switching detecting circuit detects that the received data signal is switched from the data signal of the first standard to a data signal of a second standard, it controls the transition frame generating circuit to generate the transition frames to drive the display panel; then a second data frame generated by the data frame generating circuit corresponding to the data signal of the second standard is applied to drive the display panel;

wherein a refresh frequency of the first data frame differs from a refresh frequency of the second data frame; a refresh frequency of the transition frames is between the refresh frequency of the first data frame and the refresh frequency of the second data frame.

13. The driving circuit according to claim 12, wherein the driving circuit comprises a timing control circuit; the data frame generated by the data frame generating circuit and the transition frames generated by the transition frame generating circuit are sent to the timing control circuit to drive the display panel.

14. The driving circuit according to claim 13, wherein the driving circuit further comprises a system chip; the receiving circuit, the data frame generating circuit, the transition frame generating circuit, and the standard switching detecting circuit are integrated on the system chip.

15. The driving circuit according to claim 13, wherein the driving circuit comprises a frequency locking circuit for protection; when fluctuation of a signal frequency of the data signal exceeds a predetermined threshold, the frequency locking circuit triggers a frequency lock function, determines that an input data signal is abnormal, and interrupts the input data signal to protect the display panel.

16. The driving circuit according to claim 12, wherein the transition frame generating circuit is connected with the receiving circuit through the data frame generating circuit; the transition frame generating circuit receives the data signal of the data frame generated by the data frame generating circuit to generate the transition frames.

17. The driving circuit according to claim 12, wherein the transition frame generating circuit is directly connected to the receiving circuit; the data frame generating circuit is directly connected to the receiving circuit; the standard switching detecting circuit detects the data signal received by the receiving circuit, and controls the data frame generating circuit to generate the data frame or controls the transition frame generating circuit to generate the transition frames to drive the display panel.

18. A display device, comprising a display panel and a driving circuit; wherein the driving circuit drives the display panel to display; wherein the driving circuit comprises:

a receiving circuit receiving a data signal;

a data frame generating circuit receiving and switching the data signal to generate a corresponding data frame;

a transition frame generating circuit generating transition frames according to the received data signal; and a standard switching detecting circuit detecting the data signal received by the receiving circuit, controlling the data frame generating circuit to generate the data frame, and controlling the transition frame generating circuit to generate the transition frames;

wherein when the standard switching detecting circuit detects that the received data signal is a data signal of a first standard, it controls a first data frame generated by the data frame generating circuit corresponding to the data signal of the first standard to drive the display panel;

when the standard switching detecting circuit detects that the received data signal is switched from the data signal of the first standard to a data signal of a second standard, it controls the transition frame generating circuit to generate the transition frame to drive the display panel; then a second data frame generated by the data frame generating circuit corresponding to the data signal of the second standard is applied to drive the display panel.

19. The display device according to claim 18, wherein the transition frame generating circuit is connected with the receiving circuit through the data frame generating circuit, the transition frame generating circuit receives the data signal of the data frame generated by the data flame generating circuit to generate the transition frames; the standard switching detecting circuit detects the data signal received by the receiving circuit; the signal of the data frame generated by the data frame generating circuit is output to the transition frame generating circuit to generate the transition frames to drive the display panel.

20. The display device according to claim 18, wherein the transition frame generating circuit is directly connected to the receiving circuit; the data frame generating circuit is directly connected to the receiving circuit; the standard switching detecting circuit detects the data signal received by the receiving circuit, and controls the data frame generating circuit to generate the data frame or controls the transition frame generating circuit to generate the transition frames to drive the display panel.

* * * * *